US006440049B1

(12) United States Patent
Belanger et al.

(10) Patent No.: US 6,440,049 B1
(45) Date of Patent: Aug. 27, 2002

(54) FOLDER WITH EARLY WARNING JAM DETECTION SYSTEM AND RELATED METHOD

(75) Inventors: Roger Robert Belanger, Dover; William John Blank, Newmarket; Brian Robert Elkinson, Rochester; Erik John Ramsay, Epping; Kevin Francis Albert, Barrington, all of NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 300 days.

(21) Appl. No.: 09/017,187

(22) Filed: Feb. 2, 1998

(51) Int. Cl.[7] ..... B31B 1/00

(52) U.S. Cl. ..... 493/14; 493/12; 493/13; 493/19; 493/20; 493/23

(58) Field of Search ..... 493/12, 13, 14, 493/19, 20, 23

(56) References Cited

U.S. PATENT DOCUMENTS 4,496,337 A 1/1985 Meenen
4,573,671 A 3/1986 Reponty
4,578,052 A 3/1986 Engel et al.
5,169,140 A * 12/1992 Wenthe, Jr. ..... 271/228
5,172,907 A * 12/1992 Kalisiak ..... 271/227
5,482,265 A * 1/1996 Nakazato et al. ..... 271/242
5,516,094 A 5/1996 Sander
5,678,159 A * 10/1997 Williams et al. ..... 271/228
5,681,036 A * 10/1997 Wakahara et al. ..... 271/227
5,725,211 A * 3/1998 Blanchard et al. ..... 271/265.02
5,749,823 A * 5/1998 Richards ..... 493/23

OTHER PUBLICATIONS

Nakagawa Masakatsu, "Transport–State Judging Apparatus for Paper", Jan. 1, 1986, Patent Abstract of Japan No. 61023054.*

* cited by examiner

*Primary Examiner*—Rinaldi I. Rada
*Assistant Examiner*—Christopher Harmon
(74) *Attorney, Agent, or Firm*—Kenyon & Kenyon

(57) ABSTRACT

A folder for processing a stream of printed signatures from a printing press and related method. The signatures have a desired path with a path edge and each signature has a lead and trail edge. The folder comprises a plurality of sensor sets, each sensor set for determining if the lead and/or trail edge of the signature deviates from the path edge by more than a certain tolerance.

11 Claims, 3 Drawing Sheets

1
2
42
40
12
52
20
11
50
50B
5
30
50A
54
22
8
10
13
32

FOLDER WITH EARLY WARNING JAM DETECTION SYSTEM AND RELATED METHOD

FIELD OF THE INVENTION

The present invention relates generally to folders of printing presses and more specifically to folders having a detection system for paper jams and a method for detecting such paper jams.

RELATED TECHNOLOGY

U.S. Pat. No. 4,578,052 describes a method and apparatus to determine deviations in folded sheets. The apparatus has sensors to test the folds of the folded sheet based on markings on the sheets. The apparatus however requires that the signatures be specially marked and merely tests if the folds after each folding step were properly made. The apparatus does not sense the edge of the signatures.

U.S. Pat. No. 4,573,671 describes a device for slowing down signatures before folding a signature in a chopper folder. No deviations are detected within the folder device;

Both U.S. Pat. No. 4,578,052 and 4,573,671 are hereby incorporated by reference herein.

SUMMARY OF THE INVENTION

The present invention provides a folder for processing a stream of signatures having a desired path with a path edge and each signature having a lead and trail edge. The folder comprises a plurality of sensor sets, with each sensor set determining if the lead and edge of the signature deviates from the path edge by a certain tolerance.

The present invention therefore provides for quick and easy monitoring of an entire stream of sheets or signatures in the folder. No markings on the signatures are required. An early and quick detection of possible problems in the folder is thus ensured. If press operators are forewarned of excessive signature to signature deviations, then they may correct the deviations before a jam occurs or products are wasted.

Preferably, each sensor set comprises a pair of laser emitters and a pair of diode receivers for sensing the edge of the signature.

Advantageously, when an excessive deviation is determined, the press is slowed down automatically to permit correction by the operator.

Outputs of the sensors are wired into a terminal block or box which will accept a port connector from a data acquisition card. A personal computer having a standard microprocessor and the data acquisition card with related software then can analyze the output of the sensors to identify a skew or gap variation. A monitor of a computer can provide information as to where the error in the folder has occurred. By having multiple sets of sensors in the folder, the problem area can be quickly determined by the operator.

The folder also comprises a cutting cylinder. One of the plurality of sensor sets can be located right after the cutting cylinder.

The desired path and spacing of the signatures can be predetermined by the operator, as can the amount of permissible error or deviation, i.e. the system tolerance. The desired path also could be determined based on a sampling of signatures, with the system tolerance being determined based on a standard deviation statistical analysis.

The present invention also provides a method for detecting deviations in a stream of signatures in a folder, the stream of signatures having a desired path with a path edge and each signature having a lead and trail edges the method comprising the steps of sensing the lead and/or trail edge of the signature in a plurality of locations within the folder and outputting an error message if the lead and/or trail edge of the signature deviates from the path edge by more than a tolerance.

The method further comprises the step of automatically slowing down the stream of signatures upon detection of the error message. This then prevents an excessive amount of printed signatures from being unusable and results in substantial savings in paper and other materials.

The outputted error message may identify one of the plurality of locations in which the deviation occurred.

The method further comprises The step of predetermining the tolerance,

BRIEF DESCRIPTION OF THE DRAWING

Other characteristics and advantages of the present invention may be better understood based on the following description, in which.

DETAILED DESCRIPTION

Figure 1:
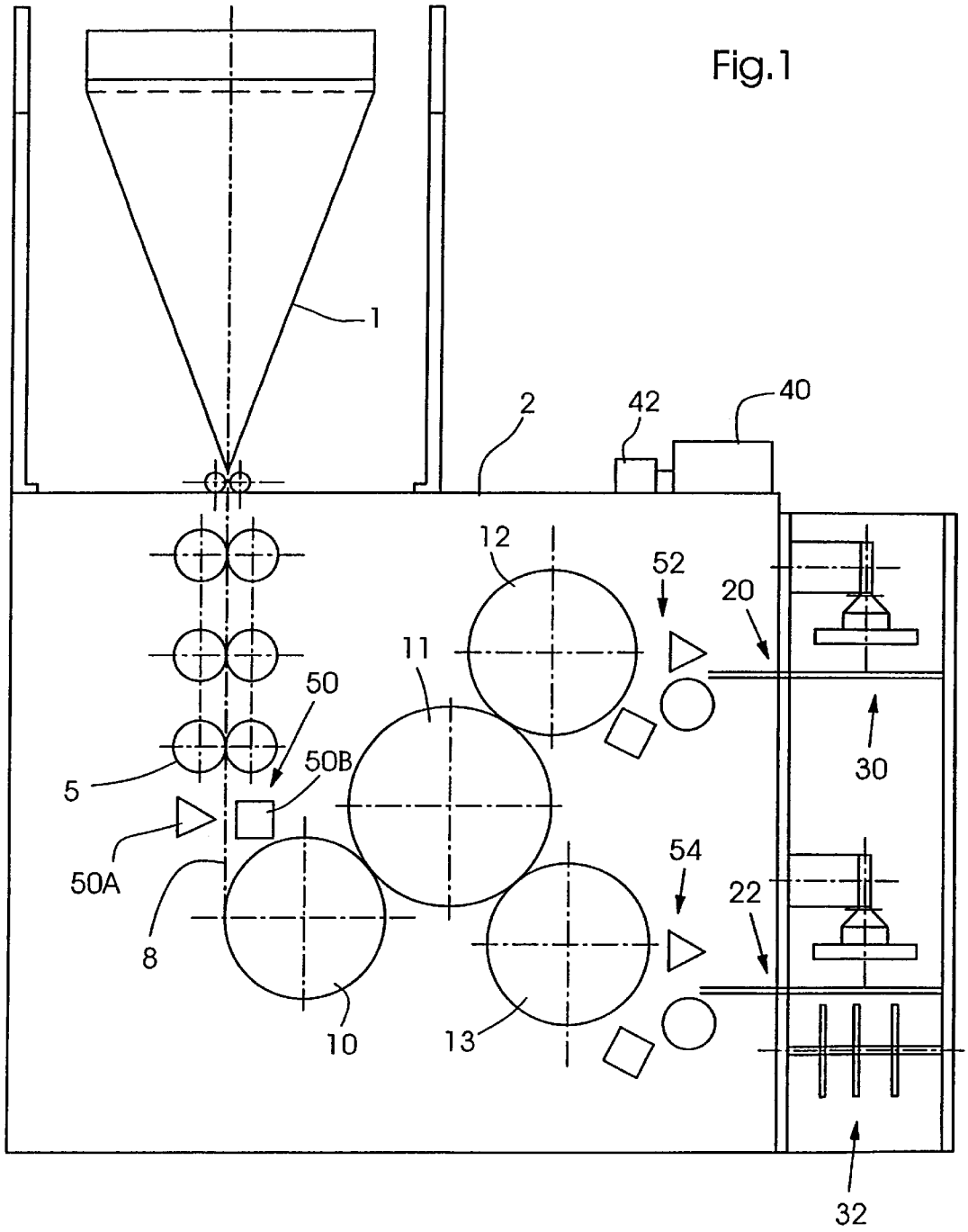
FIG. 1 shows a folder of the present invention.

FIG. 1 shows a web 1 of paper entering a folder 2. A cutting cylinder 5 cuts the web 1 to create a stream of signatures 8. The signatures 8 can then be folded as desired by folding elements 10, 11, 12, and 13. and the stream diverted to one of two quarter folder entrances 20 and 22.

Sensor sets 50, 52 and 54 are provided at various locations through the folder. Sensor set 50 is located just downstream of the cutting cylinder, and sets 52 and 54 just upstream of quarter fold regions 30, 32, respectively. Each sensor set comprises a pair of laser emitters and diode receivers located on both sides of a center line of a desired path for the signatures, the laser emitter and diode receiver of one sensor of the set being located on one side of the centerline, the laser emitter and receiver diode of the other sensor of the set being located on the other side of the centerline, as indicated on one side by laser emitters 50A and diode receivers 50B. Each sensor set can be passed first through a terminal block 42 connected to a computer 40 so that the computer can identify which sensor has sensed a signature deviation.

Figure 2A:
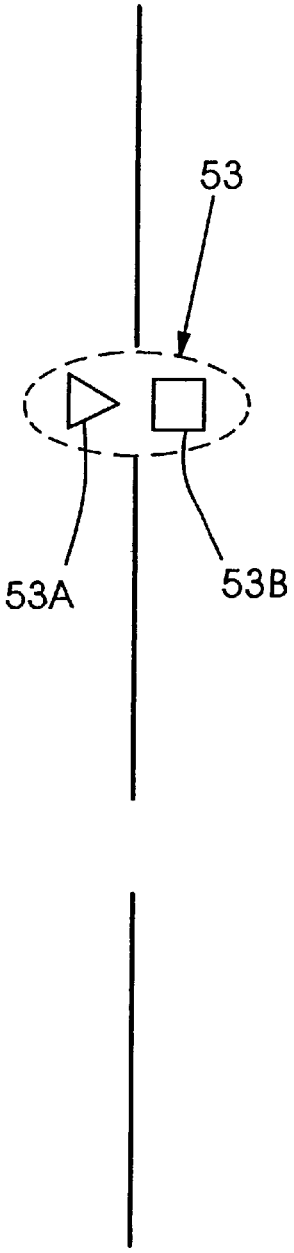
FIGS. 2*a* and 2*b* show a stream of signatures and a sensor set of the present invention showing an acceptable stream of signatures.
Figure 2B:
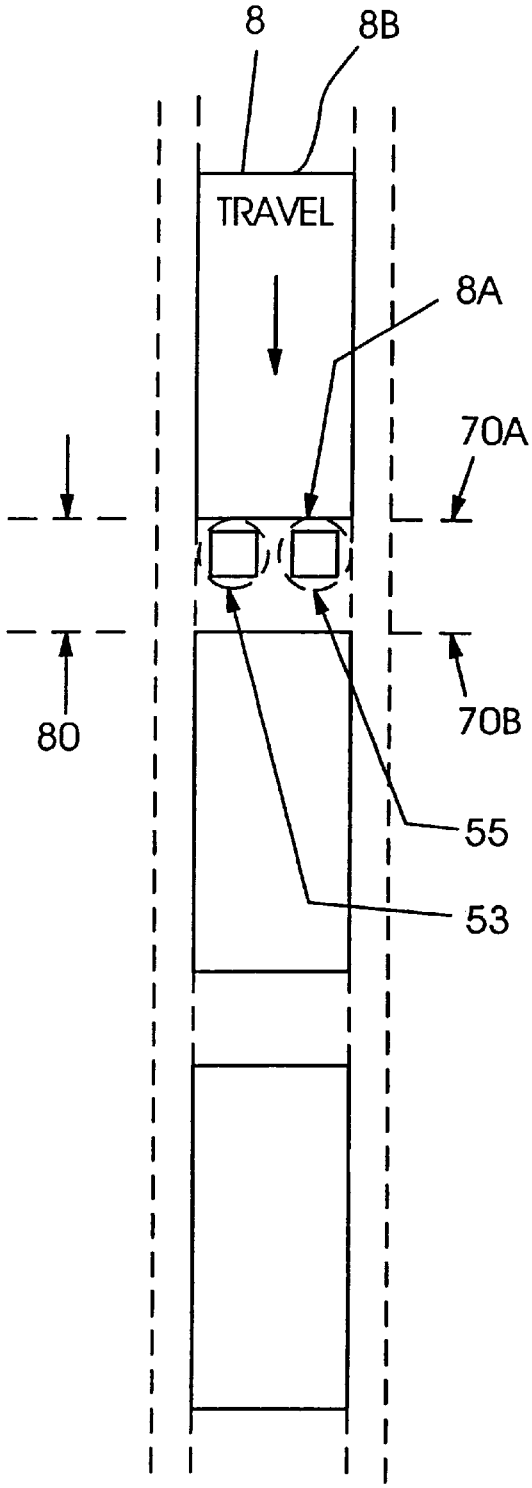

FIGS. 2A and 2B shows a front and side view of a stream of signatures 8 being sensed by a pair of sensors 53 and 55 located next to each other. Each signature has lead and trail edges 8A and 8B and preferably follows a desired path having desired path edges 70A and 70B. Sensor 53 comprises laser emitter 53A and diode receiver 53B on either side of the signature 8, the laser emitter 53A sending a laser beam to be received by diode receiver 50B. A distance 80 defines a book-to-book spacing between signatures.

FIGS. 2A and 2B show a stable signature delivery, as the signatures are spaced properly apart and are not skewed. The sensors 53 and 55 form a sensor set to monitor the signature stream by monitoring the lead and/or trail edges 8A and 8B. For example, the computer monitors if there is a time difference between the time when sensor 53 detects lead edge 8A and when sensor 5 detects lead edge 8A. If the time difference is zero, then the signature is perpendicular to the centerline of travel, which means there is no skew. The computer program can thus output to an associated display (not shown) that there is 0.000" skew. The trail edge can likewise be sensed.

Figure 3:
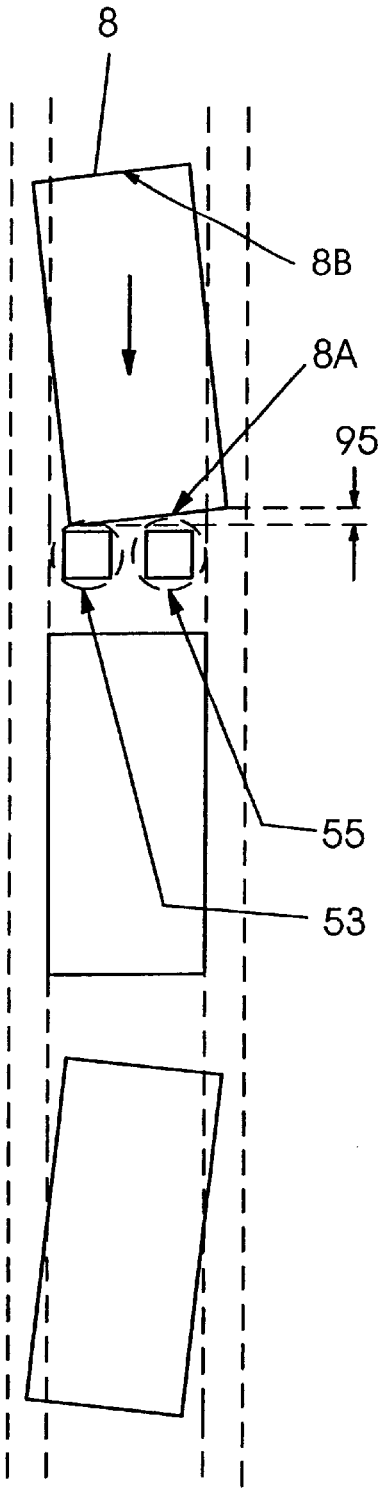
FIG. 3 shows a stream of signatures with a skew.

FIG. 3 shows a skewed signature 8 with lead edge 8A and trail edge 8B. A skew 95 thus occurs between when the sensor 53 and the sensor 55 sense the lead edge 8A of the signature 8, and thus the sensor 55 senses the lead edge 8A at a certain time difference after sensor 53 senses lead edge 8A. The computer program can monitor the signature speed from an encoder on the cut cylinder and multiply it by the time difference to determine the skew dimension, which can then be displayed. As a function of the skew dimension, further action such as a slowing or stopping of the printing press can occur.

Figure 4:
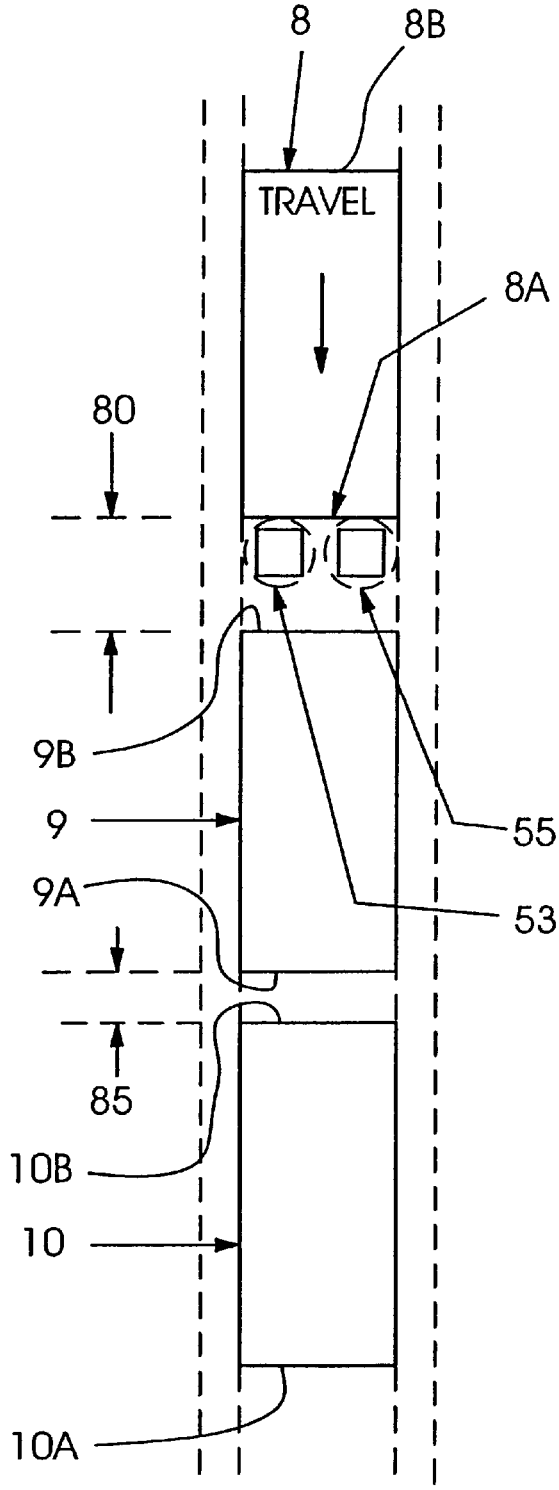
FIG. 4 shows a stream of signatures with a signature gap variation.

The signature-to-signature (book-to-book) spacing can also be monitored, as shown in FIG. 4. Either sensor 53 and 55 (or both or an average signal of both) can be used to sense the trail and lead edges of signatures 8, 9 and 10. Signatures 8, 9 and 10 have lead edges 8A, 9A, 10A and trail edges 8B, 9B and 10B, respectively. The time between the edges 10B and 9A can thus be used to determine a spacing difference 85 between signatures 10 and 9 and the time between the edges 9B and 8A to determine a spacing difference 80 between signatures 9 and 8. As a function of the time or the spacing between the signatures, further action such as slowing or stopping of the press can occur.

It should be understood that several side-by-side sensor sets can be placed throughout the folder.

What is claimed is:

1. A folder for processing a stream of signatures having a desired path and each signature having a lead and a trail edge, the folder comprising:

a plurality of sensor sets, each of the plurality of sensor sets for measuring a deviation of one of the lead and trail edge of the signature from the desired path, one of the plurality of sensor sets being disposed downstream of a cutting cylinder and another of the plurality of sensor sets being disposed upstream of a quarter fold region, each of the plurality of sensor sets including a first laser emitter associated with a first diode receiver and a second laser emitter associated with a second diode receiver, the first laser emitter and first diode receiver being disposed on a first side of a centerline of the desired path, the second laser emitter and the second diode receiver being disposed on a second side of the centerline.

2. The folder as recited in claim 1 wherein the first laser emitter and the first diode receiver are located side-by-side the second laser emitter and the second diode receiver.

3. The folder as recited in claim 1 further comprising a microprocessor, each of the plurality of sensor sets having an output for connecting to the microprocessor.

4. A method for detecting deviations in a stream of signatures in a folder, each signature having a lead and trail edge, the method comprising the steps of:

sensing one of the lead edge and the trail edge by a first sensor disposed at a first location downstream of a cutting cylinder, the first location being on a first side of a centerline of a desired path of the stream of signatures;

sensing one of the lead edge and the trail edge by a second sponsor disposed at a second location downstream of a cutting cylinder, the second location being on a second side of the centerline;

determining a first skew in the signature by comparing an output of the first sensor with an output of the second sensor;

sensing one of the lead edge and the trail edge by a third sensor disposed at a third location upstream of a quarter folder region, the third location being on the first side of the centerline;

sensing one of the lead edge and the trail edge by a fourth sensor disposed at a fourth location upstream of a quarter folder region, the fourth location being on the second side of the centerline; and determining a second skew in the signature by comparing an output of the third sensor with an output of the fourth sensor.

5. The method as recited in claim 4 wherein the first sensor and second sensor are located side-by-side, and the third sensor and fourth sensor are located side-by-side.

6. The method as recited in claim 4 further comprising the step of slowing down the stream of signatures after the determining step by changing a press speed.

7. The method as recited in claim 4 further comprising the step of using a fifth sensor and a sixth sensor to determine a further skew.

8. The method as recited in claim 4 further comprising the step of determining a spacing between signatures in the stream of signatures.

9. A method for detecting deviations in a stream of signatures in a folder, the stream of signatures including a first signature having a first trail edge and a second signature having a second lead edge, the method comprising the steps of:

sensing the first trail edge;

sensing the second lead edge; and determining a signature-to-signature spacing as a function of the sensing the first trail edge step and the sensing the second lead edge step;

wherein the sensing and determining steps are performed both downstream of a cutting cylinder and upstream of a quarter folder region.

10. The method as recited in claim 9 wherein a pair of side-by-side sensors is used to sense the first trail edge.

11. The method as recited in claim 9 further comprising the step of slowing down the stream of signatures after the determining step by changing a press speed.

* * * * *